United States Patent [19]

Rabuffetti

[11] 4,094,702

[45] June 13, 1978

[54] METHOD AND APPARATUS FOR CONTROLLING BY-PASS LIQUID FLOW IN DISH-WASHING MACHINES

[75] Inventor: Sergio Rabuffetti, Castronno, Italy

[73] Assignee: U.S. Philips Corporation, New York, N.Y.

[21] Appl. No.: 759,058

[22] Filed: Jan. 13, 1977

Related U.S. Application Data

[63] Continuation of Ser. No. 596,970, Jul. 17, 1975, abandoned.

[30] Foreign Application Priority Data

Jul. 11, 1974 Italy ..... 25019 A/74

[51] Int. Cl.[2] ..... B08B 3/02; B08B 11/02

[52] U.S. Cl. ..... 134/10; 134/25 A; 134/176; 134/178; 239/262

[58] Field of Search ..... 134/10, 25 A, 36, 176, 134/178, 179, 191, 198; 239/245, 262

[56] References Cited

U.S. PATENT DOCUMENTS

| | | | |
|---|---|---|---|
| 3,064,665 | 11/1962 | Martiniak | 134/176 |
| 3,648,931 | 3/1972 | Jacobs | 134/176 X |

*Primary Examiner*—Richard V. Fisher
*Attorney, Agent, or Firm*—Frank R. Trifari; David R. Treacy

[57] ABSTRACT

Method and apparatus for washing dishes allowing independent control of washing liquid flow to upper and lower baskets. A valve allows selective reduction of liquid flow to an upper washing arm and/or by-passing liquid so that it does not flow through the washing arm nozzles.

3 Claims, 11 Drawing Figures

METHOD AND APPARATUS FOR CONTROLLING BY-PASS LIQUID FLOW IN DISH-WASHING MACHINES

This is a continuation of application Ser. No. 596,970, filed July 17, 1975, now abandoned.

This invention relates to a a dish washing method and dish-washing machine operating in accordance with such a method.

One of the most attractive properties to users of modern dish-washing machines is use flexibility, or capability of most efficiently washing any kitchenware or dishes and any possible combination thereof. Any kitchenware is herein referred to as more, or less, delicate kitchenware (such as pots, plates or glasses), as well as more, or less, soiled kitchenware. Since kitchenware to be washed is generally contained in two baskets, which are loaded before starting a washing cycle, to achieve the aforesaid use flexibility many dish-washing machines are provided with a control valve on the pipe from the associated circulating pump and supplying the spray devices with water and/or soap. This valve can be set by the user so that, should the bottom basket contain sturdy and highly soiled kitchenware (such as pots) and the top basket contain very delicate and less soiled kitchenware (such as crystal glasses and china cups), the water and/or soap flow is reduced in the top spray device and proportionally increased in the bottom spray device. Thus, both for hydraulic and mechanical reasons, the circulating pump generally operates at a constant flow rate.

It has been also proposed to achieve use flexibility in a dish-washing machine by providing it with devices for controlling the water and/or soap flow rate in each of the spray devices directly or indirectly driven by the timer-programmer existing on the machine. Thus, with a kitchenware batch as above mentioned, in some stages of the operative washing cycle the spray devices would receive water and/or soap at variable and differentiated flow rates, or some devices would be completely closed off.

Clearly, a dish-washing machine provided with the former type of control valve would not exhibit great use flexibility, since the water and/or soap flow rates in the two spray devices are interdependent. Therefore, for example, optimum washing could never be accomplished if both of the baskets contain very delicate, slightly soiled kitchenware.

On the other hand, control devices driven by a timer-programmer are necessarily expensive and delicate, being therefore suitable only for use on dish-washing machines somewhat more expensive than those commonly available on the market.

It is the object of the present invention to provide a washing method and dish-washing machine capable of providing the user with maximum use flexibility without significant increase in cost.

It is a further object of the present invention to provide a method for dish or kitchenware washing in a dish-washing machine which, for each of the kitchenware containing baskets, is provided with at least one spray device for water and/or soap from a single circulating pump, and characterized in that the water and/or soap flow rate, as supplied by each spray device, can be set by the user, both independently of the flow rate supplied by the other spray devices and the operative washing cycle selected by the user.

Therefore, by way of example without limitation, a useful embodiment of the invention will now be described, reference being had to the accompanying drawings in which.

Figure 1:
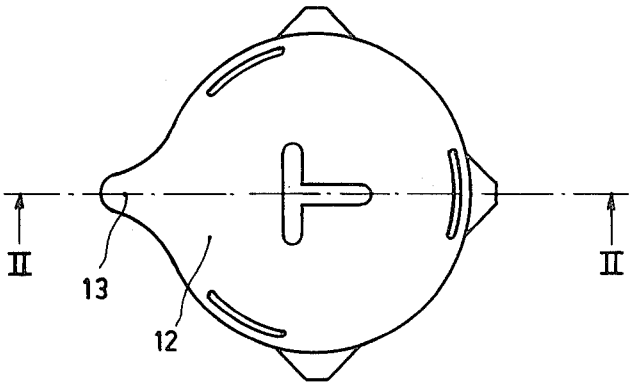
FIG. 1 is a top view showing the flow rate control device located at the upper end of the supply pipe, that is at the upper spray device.
Figure 2:
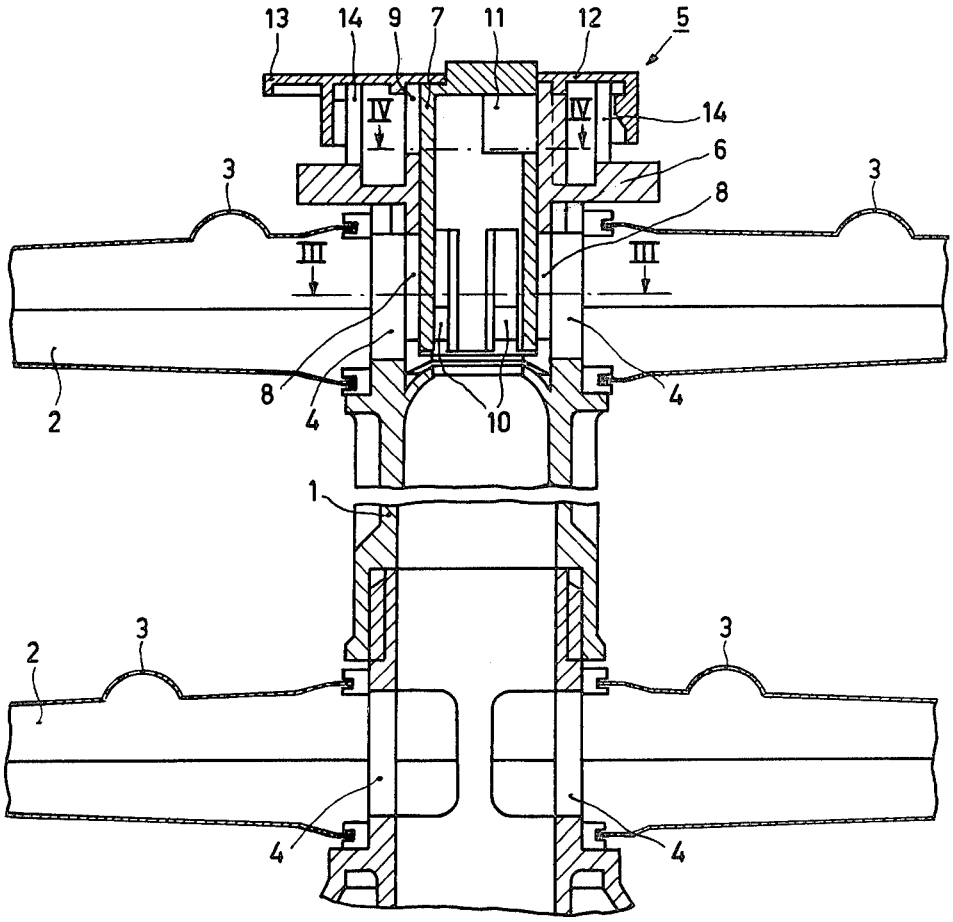
FIG. 2 is a sectional view taken along line II—II of FIG. 1.
Figure 5:
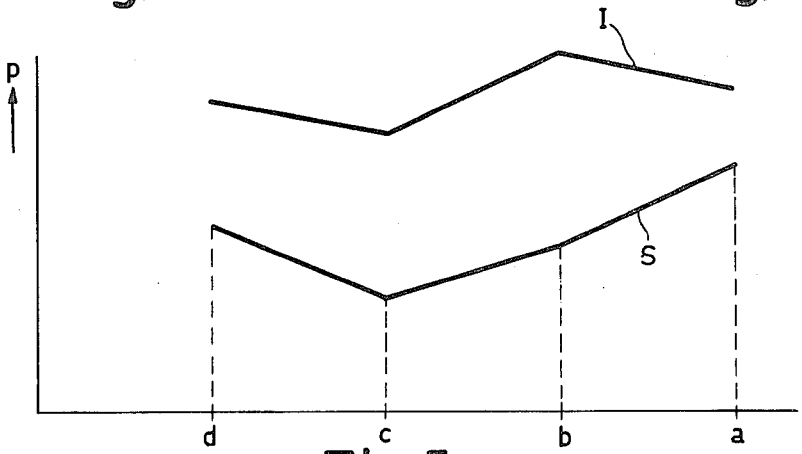

FIGS. *3a, 4a; 3b, 4b; 3c, 4c;* and *3d, 4d* are all sectional views respectively taken along lines III—III and IV—IV of FIG. 1, and show four different operating conditions for the control device; and FIG. 5 shows a graph of experimental data plotting, for each of the spray devices (such as bottom and top spray devices I and S, respectively) and for each of said four operating conditions, the rating of the water and/or soap jets supplied by the spray devices.

In the present example, the dish-washing machine is provided with a single tube 1 supplying from the machine circulating pump (not shown) both of the rotating spray devices 2 capable of sprinkling water and/or soap through nozzles 3. Water and/or soap supply to each of the spray devices 2 is provided through four circumferentially spaced slits 4. Additionally, the supply for the top spray device passes through the control device or valve 5. Device 5 comprises a tubular member 7 concentrically fitted in a tubular body member 6 and aligned with the axis of said tube 1 (which is also the axis about which the spray devices 2 rotate), the members substantially extending to the location of the corresponding slits 4 for the top spray device. The external body member 6, which is fastened, as by screw threads, on the end portion of tube 1, has at its bottom four circumferentially spaced slits 8, so as to point to the corresponding slits 4. At its top, said external body member 6 has a single port 9 extending through about 100° and, on a major diameter, the auxiliary ports 14.

The internal body member 7, telescoped within the external body member 6 with some clearance or play, also has at the bottom four circumferentially spaced slits 10 and at the top a single part 11 extending through about 100°. At the top said body member 7 has a knob secured thereto and also operating as a plug, signalling through an associated pointer 13 the selected operating condition to the user.

Thus, according to the invention, the user can manually set the control device 5 so that at least four different machine operating conditions are provided, this meaning that throughout the operative washing cycle a water and/or soap flow rate through each of the two rotating spray devices would be provided as best suited to the quality and amount of dirt of the kitchenware contained in the corresponding basket.

This setting for the control device 5 is made by the user when being about to introduce the kitchenware-containing baskets into the machine basin and exhibits the basic characteristic that the water and/or soap flow rate, as supplied through each of the spray devices, is both independent of the fow rate supplied through the other spray device and the operative washing cycle selected by the user with the aid of the timer-programmer.

This is possible because, at least at some possible operating conditions, a proportion of the total water and/or soap flow rate supplied by the circulating pump is by-passed and directly fed into the machine basin, that is without sprinkling the kitchenware contained in the corresponding basket.

Figure 4A:
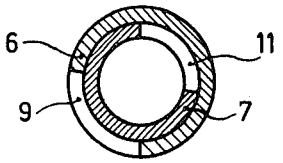
Figure 3A:
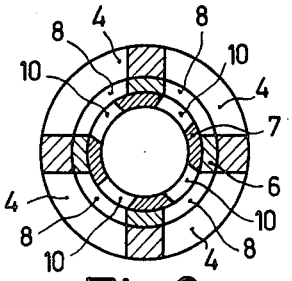

How this can be carried out will be readily taken into account when considering and comparing FIGS. 3*a*, 4*a*; 3*b*, 4*b*, 3*c*, 4*c* and 3*d*, 4*d* to one another, and also considering the diagram shown in FIG. 5.

FIGS. 3*a*, 4*a* and position *a* on the diagram correspond to the operating condition the user would adopt when having to wash kitchenware of a standard strength and normal amount of dirt, as contained in both of the baskets. In this case, the knob 12 of the control device is turned by the user so that the slits 4, 8 and 10 are exactly opposite one another, while the port 11 of the internal body member 7 remains closed by the external body member 6. In this case (assuming that the slits 4 of tube 1 are exactly the same for both of the spray devices 2) the water and/or soap flow rates supplied by the latter are equal to each other.

Figure 4B:
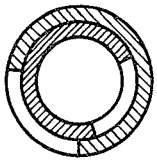
Figure 3B:
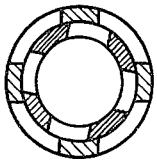

On the other hand, should the user have to wash both delicate or little soiled kitchenware (contained in the top basket) and sturdy and highly soiled kitchenware (contained in the bottom basket), the user will set the knob 12 so that the operating condition is that shown in FIGS. 3*b*, 4*b*, and designated at *b* on the diagram shown in FIG. 5. Thus, it will be seen that not only said port 11 is still closed by the external body member 6, but also the slits 10 of the internal body member 7 are partially closed by said external body member 6. Accordingly, the water and/or soap flow rate supplied through the top spray device is lowered and the flow rate through the bottom spray device is correspondingly increased. Under this operating condition, this control device has the same characteristics as the prior art valve discussed above. More particularly, the bottom of the control device, that is the portion in front of the slits 4 supplying the top spray device, forms a valve of the above mentioned type. However, unlike this valve, the control device according to the invention provides the user, owing to the other elements comprising it, with two further operating conditions, which gives larger use flexibility to the machine.

Figure 4C:
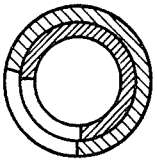
Figure 3C:
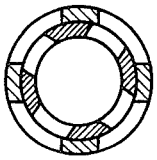

The condition, as shown in FIGS. 3*c*, 4*c* and corresponding to the condition *c* on the diagram of FIG. 5 is selected by the user when having to wash extremely delicate and little soiled kitchenware contained in both baskets. Thus, the slits 10 are partially closed by the external body member 6, while the ports 11 and 9 are correctly and completely opposite to each other.

Therefore, a proportion of the total water and/or soap flow rate supplied by the circulating pump (and selected by the user) is by-passed and fed into the machine basin through the ports 11 and 9, as well as through the auxiliary ports 14. The latter are shaped so that the portion of water and/or soap outcoming therethrough will not sprinkle the kitchenware contained in the top basket, but rather will be returned to the machine basin for recirculation by the circulating pump.

It is apparent that the opening of said ports 11 and 9 would render the flow rate supplied by each of the spray devices independent of the flow rate supplied through the other spray device. This result could not be achieved in known dish-washing machines or, at the most, was achieved only at some stages of a full operative washing cycle of the machine.

On the other hand, in our case, this operating condition, when selected by the user, will last for the full duration of the operative washing cycle. Therefore, this means that, in accordance with a further essential aspect of the present invention, said operating condition is also independent of the operative washing cycle selected by the user through the timer-programmer.

That this is the best operating condition with a large batch of very delicate kitchenware is shown by the diagram of FIG. 5 showing, at the condition *c*, the minimum pressure rates for the jets delivered both by the top spray device (S) and the bottom spray device (I).

Figure 4D:
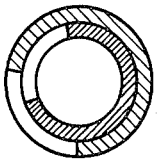
Figure 3D:
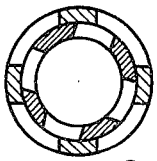

Finally, at the operating condition designated at *d* on the diagram of FIG. 5 and shown in FIGS. 3*d*, 4*d*, the port 11 is only partially open, as well as the slits 10. This operating condition is selected by the user when having to wash a reduced amount of delicate kitchenware (contained in the top basket) and normal kitchenware (contained in the bottom basket). In this case, the water and/or lye flow rate is still independent in each of the two spray devices, as a portion of the total flow rae is again by-passed and directly fed into the basin.

The diagram shown in FIG. 5, under the condition *d*, shows such a circumstance in connection with the pressure of the jets delivered by the two spray devices.

When desiring to further increase the machine use flexibility, according to the invention a control device like that herein described can be mounted also at the bottom spray device, not only where a single tube supplies the two spray devices, but also where said two or more spray devices are supplied parallel one another. In such a case, it is evident that a suitable operating condition can be provided for a user wishing to wash at the same time delicate kitchenware, now contained in the bottom basket, and highly or normally soiled kitchenware (now contained in the top basket.

The most significant advantages of the present invention have been partly described above and can be summarized in an enormous increase in the use flexibility of the dish-washing machine, such an increase being obtained in a very simple and efficient manner and throughout the operative washing cycle.

What is claimed is:

1. A method of washing dishes in a dish-washing machine having a plurality of baskets for containing dishes, at least one washing liquid spray device associated with each basket and having spray nozzles, and providing at least one selectable operative cycle, and a single means for circulating washing liquid to said spray devices, comprising setting a reduced flow rate to each spray device independently of the flow rate of other spray devices and the operative cycles selected, by the step of by-passing a portion of circulated liquid from flowing through any of the spray nozzles and returning said portion for recirculation by the single means.

2. In a dish-washing machine having a plurality of baskets, at least one washing liquid spray device associated with each basket and having spray nozzles, and a single means for circulating washing liquid to said spray devices, the improvement comprising a manually settable valve for controlling flow of liquid to each spray device independently of flow to other spray devices, said valve comprising means responsive to selection of at least one valve setting for by-passing a portion of the circulated liquid from flowing through any of the spray nozzles, said portion being returned directly for re-circulation by said single means.

3. A machine as claimed in claim 2, wherein said valve includes means for manually setting prior to commencement of a washing cycle and for maintaining that setting throughout the cycle.

* * * * *